United States Patent [19]

Slack

[11] Patent Number: 4,561,491

[45] Date of Patent: Dec. 31, 1985

[54] INVESTMENT CASTING

[75] Inventor: John D. Slack, Matlock, England

[73] Assignee: Rolls-Royce Limited, London, England

[21] Appl. No.: 671,310

[22] Filed: Nov. 14, 1984

[30] Foreign Application Priority Data

Dec. 7, 1983 [GB] United Kingdom ..... 8332566

[51] Int. Cl.[4] ..... B22C 9/24; B22C 9/04

[52] U.S. Cl. ..... 164/516; 164/35; 164/122.1

[58] Field of Search ..... 164/34–36, 164/516–519, 122.1, 122.2, 246, 45

[56] References Cited

U.S. PATENT DOCUMENTS 4,289,191 9/1981 Myllymaki ..... 164/45

FOREIGN PATENT DOCUMENTS 1300199 7/1969 Fed. Rep. of Germany ..... 164/45

2053047 2/1981 United Kingdom ..... 164/246

*Primary Examiner*—Kuang Y. Lin

*Attorney, Agent, or Firm*—Cushman, Darby & Cushman

[57] ABSTRACT

A method of manufacturing a mould for use in the investment casting of a hollow gas turbine engine blade in which a ceramic core is coated with a surface modifying material prior to the application of wax thereto to define a pattern of the object to be cast. The surface modifying material adheres to the core and provides a textured surface to which the wax keys, thereby preventing the wax lifting from the core.

5 Claims, 1 Drawing Figure

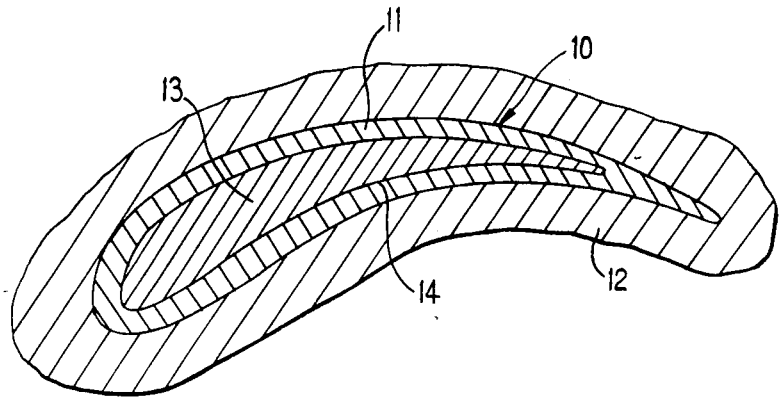
11
10
13
14
12

INVESTMENT CASTING

This invention relates to investment casting and in particular to the manufacture of a mould for use in investment casting.

In the investment casting process, a wax pattern of the object which is to be cast is covered with a refractory material to define a mould whereupon the wax is melted and run out and the resultant cavity filled with molten metal. It is frequently necessary when casting objects using this process to include one or more disposable cores within the wax pattern which, when casting has been carried out serve to define holes or cavities in the object. The wax is usually injection moulded around the core or cores prior to the application of the refractory material. There is a tendency however for the wax to lift off certain of the core surfaces as it cools after the injection moulding step. Concave core surfaces are particularly prone to this effect. Such lifting results in the distortion of the shape of the wax pattern and hence the shape of the cast object.

One type of cast object which is often troubled by wax lifting during its manufacture is a hollow gas turbine engine aerofoil blade. It is frequently found that the wax of the pattern which abuts the concave surfaces of the core tends to lift off those surfaces. One way in which this problem has been tackled in the past has been to provide a hook or similar feature on the core surface which serves to retain the wax pattern in position. However such hooks, since they are on the core, subsequently serve to define possibly undesirable holes in the eventually cast blade.

A similar problem can occur if it is desired to deposit additional wax on an existing wax pattern. Thus if molten wax is deposited on to a concave surface of an existing wax pattern, there is a danger that the newly applied wax will lift off the original wax pattern as it cools down. In such a situation, the provision of a hook or other feature on the original wax pattern is unlikely to be effective in preventing wax lifting in view of the poor strength characteristics of the waxes which are conventionally used.

It is an object of the present invention to provide a method of manufacturing a mould for use in casting in which wax lifting can be substantially eliminated and which does not result in undesirable holes in the cast object.

According to the present invention, a method of manufacturing a mould for use in the investment casting of an object comprises constructing a pattern of the object to be cast from two abutting components, one of which is made from wax and is moulded on to the other of said components, said other of said components having a thermally decomposable surface modifying coating adhered to the surface or surfaces thereof which abut said wax component which coating presents a surface or surfaces to said wax component which is or are of such a texture as to facilitate the keying of said wax component thereto, coating said pattern with a refractory material to define a mould, heating said mould at a temperature at which said wax melts and said surface modifying coating thermally decomposes and pouring said molten wax and decomposition products of said surface modifying coating out of said mould, said thermally decomposable surface modifying coating being selected so as to provide minimal particulate decomposition products as a result of said mould heating step.

BRIEF DESCRIPTION OF DRAWING

The invention will now be described, by way of example, with reference to the accompanying drawing which is a sectioned plan view of an aerofoil shape cross-section pattern within a mould manufactured in accordance with the method of the present invention.

In the manufacture of a hollow aerofoil cross-section turbine blade for a gas turbine engine by investment casting a pattern 10 of the blade is coated with a conventional refractory material 12 in order to define a mould. The pattern 10 is made up of two parts, a wax component 11, which is of the same external configuration as the turbine blade and a length-wise extending ceramic core 13 which is enclosed by the wax component 11 and defines the hollow interior of the blade. The ceramic core 13 extends beyond the wax component 11 in a lengthwise direction to engage and be retained in position by the refractory material 12. Such a method of mould construction is well known in the manufacture of components by casting and will not therefore be described in detail.

In the manufacture of the pattern 10, the ceramic core 13 is placed in a suitably shaped mould and molten wax is injection moulded around it. Since the molten wax contracts as it cools there is as previously stated a problem in ensuring that the wax is maintained in contact with the concave face 14 of the ceramic core 13 as it cools down. This is achieved by spraying the concave core face 14 prior to wax injection moulding with a surface modifying coating. The coating which we prefer to use is marketed as Scotch Photomount Adhesive ("Scotch" is a registered trade mark) and is obtainable from 3M (UK) Limited. This coating material, which comprises an adhesive material in solvent solution, serves, after solvent evaporation, to provide the concave core face 14 with a finish which is of such a texture as to cause the wax component 11 to mechanically key itself to it. It will be appreciated however that alternative materials could be used to maintain the wax component 11 in engagement with the concave core face 14. Essentially the materials should adhere to the concave core face 14 and, after solvent evaporation, provide a textured surface to which the wax component 11 keys itself. The surface modifying coating should additionally thermally decompose to provide minimal particulate decomposition products. This is because after the refractory material 12 has been applied to the pattern 10 to define a mould, the whole assembly is heated in order to melt the wax component 11 whereupon the molten wax is poured out of the mould. It is important therefore that at the temperature at which the mould is heated, the coating material thermally should decompose and leave as little residue as possible. If any of the coating material or its decomposition products were to be left in the mould after removal of the wax, they could give rise to undesirable inclusions in the subsequently cast turbine blade.

When the wax component 11 and coating composition have been removed from the mould defined by the refractory material 12, the resultant enclosure is filled with molten metal in the usual manner. Since the use of the surface modifying coating does not necessitate any modification of the pattern 10, the finally cast turbine blade does not have any of the holes or projections on it which can result from other methods of preventing wax lifting from pattern components.

Although the present invention has been described with reference to a pattern 10 which is formed from a wax component 11 and a ceramic core 13, it will be appreciated that other forms of pattern could be utilised in the method of the present invention. Thus it could be used in methods in which the ceramic core 13 is replaced by a further wax component. In such an arrangement a wax core would be coated with the surface modifying coating prior to the injection moulding of more wax around the core. The surface modifying coating must of course be one which adheres to the initial wax component.

It will also be appreciated that although the present invention has been described with reference to the manufacture of a mould for use in the casting of a gas turbine engine turbine blade, it is applicable to the manufacture of moulds for use in the casting of other components.

I claim:

1. A method of manufacturing a finished mould for use in the investment casting of an object comprising the steps of:

providing at least a portion of a first component with a thermally decomposable surface modifying coating having a texture to facilitate keying of wax thereto and decomposable into minimal particulate decomposition products when heated;

moulding a second component made from wax into abutting relationship with said first component and said at least a portion of said thermally decomposable surface modifying coating to form a pattern;

coating said pattern with a refractory material to define a mould;

heating said mould at a temperature sufficient to melt the wax of said second component and sufficient to thermally decompose said surface modifying coating into said minimal particulate decomposition products; and pouring said molten wax and said minimal particulate decomposition products of said surface modifying coating out of said mould.

2. A method of manufacturing a mould as claimed in in claim 1, including the step of making said first component from a ceramic material to form a core.

3. A method of manufacturing a mould as claimed in claim 1, including the step of applying an adhesive material in a solvent solution to said first component as said surface modifying coating and then evaporating off said solvent solution prior to moulding of said second component made from wax to said first component.

4. A method of manufacturing a mould as claimed in claim 3, including the step of spraying said adhesive material in said solvent solution onto said first component.

5. A method of manufacturing a mould as claimed in claim 1 wherein said cast object is a hollow aerofoil blade for a gas turbine engine.

* * * * *